US011322893B2

(12) United States Patent
Zhang et al.

(10) Patent No.: US 11,322,893 B2
(45) Date of Patent: May 3, 2022

(54) ELECTRICAL CONNECTOR

(71) Applicant: LOTES CO., LTD, Keelung (TW)

(72) Inventors: Biao Zhang, Keelung (TW); Jia Xu Yin, Keelung (TW); Chong Cheng Liang, Keelung (TW); Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/077,391

(22) Filed: Oct. 22, 2020

(65) Prior Publication Data

US 2021/0126402 A1 Apr. 29, 2021

(30) Foreign Application Priority Data

Oct. 25, 2019 (CN) ..... 201911024579.4

(51) Int. Cl.
*H01R 13/6477* (2011.01)
*H01R 12/73* (2011.01)
(Continued)

(52) U.S. Cl.
CPC ..... *H01R 13/6477* (2013.01); *H01R 12/737* (2013.01); *H01R 13/11* (2013.01);
(Continued)

(58) Field of Classification Search
CPC .. H01R 13/6477; H01R 13/11; H01R 13/502; H01R 13/64; H01R 13/6581; H01R 13/6597; H01R 12/737
(Continued)

(56) References Cited

U.S. PATENT DOCUMENTS 4,077,688 A * 3/1978 Cobaugh ..... H01R 12/88 439/267
6,019,616 A * 2/2000 Yagi ..... H01R 13/6582 439/108
(Continued)

FOREIGN PATENT DOCUMENTS

CN 200990423 Y 12/2007
CN 108448287 A 8/2018
(Continued)

*Primary Examiner* — Peter G Leigh
(74) *Attorney, Agent, or Firm* — Locke Lord LLP; Tim Tingkang Xia, Esq.

(57) ABSTRACT

An electrical connector includes an insulating body having a mating surface. An insertion slot is concavely provided on the mating surface. Two side walls are located at two sides of the insertion slot. A slot bottom surface is formed on a concave direction of the insertion slot. One of the side walls is provided with aground accommodating slot and a signal accommodating slot. A signal terminal and a ground terminal are provided on the one of the side walls. The signal terminal is accommodated in the signal accommodating slot. The ground terminal is accommodated in the ground accommodating slot. A side of the insulating plug member has a first portion corresponding to the signal accommodating slot and a second portion corresponding to the ground accommodating slot. The first portion is accommodated in the signal accommodating slot and is provided closer to the mating surface than the slot bottom surface.

25 Claims, 16 Drawing Sheets

(51) Int. Cl.
*H01R 13/11* (2006.01)
*H01R 13/502* (2006.01)
*H01R 13/64* (2006.01)
*H01R 13/6581* (2011.01)
*H01R 13/6597* (2011.01)

(52) U.S. Cl.
CPC ..... *H01R 13/502* (2013.01); *H01R 13/64* (2013.01); *H01R 13/6581* (2013.01); *H01R 13/6597* (2013.01)

(58) Field of Classification Search
USPC ..... 439/607.32
See application file for complete search history.

(56) References Cited

U.S. PATENT DOCUMENTS 6,213,804 B1 * 4/2001 Matsumura ..... H01R 12/87 439/267
6,979,216 B2 * 12/2005 Maeda ..... H01R 12/88 439/260
7,048,585 B2 * 5/2006 Milbrand, Jr. ..... H01R 13/6585 439/607.09
7,338,303 B1 * 3/2008 Yi ..... H01R 12/87 439/267
7,497,713 B1 * 3/2009 Huettner ..... H01R 27/00 439/265
8,449,335 B2 * 5/2013 Briant ..... H01R 12/7005 439/637
8,579,662 B2 * 11/2013 Briant ..... H01R 12/716 439/607.08
9,048,581 B2 * 6/2015 Briant ..... H01R 13/4361
9,065,225 B2 6/2015 Degner et al.
10,439,311 B2 * 10/2019 Phillips ..... H01R 12/7005
10,454,203 B2 * 10/2019 Phillips ..... H01R 12/721
2005/0186820 A1 * 8/2005 Maeda ..... H01R 13/193 439/260
2019/0074616 A1 * 3/2019 Hou ..... H01R 13/055
2019/0190212 A1 * 6/2019 Fang ..... H01R 13/646
2019/0214755 A1 * 7/2019 Manickam ..... H01R 12/721
2019/0280420 A1 * 9/2019 Phillips ..... H01R 13/514

FOREIGN PATENT DOCUMENTS

CN 109193193 A * 1/2019 ..... H01R 12/716
CN 109273889 A 1/2019
CN 208461040 U 2/2019
CN 208539156 U 2/2019
CN 108832339 B * 10/2019 ..... H01R 12/721
CN 107017526 B 2/2020
CN 109273889 B * 9/2020 ..... H01R 12/7005

* cited by examiner

A-A

D-D

E-E

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201911024579.4 filed in China on Oct. 25, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector used to transmit high frequency signals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With the current development of electronic technology, electrical connectors play an important role in the electronic technology field. With the velocity of the signal transmission becoming faster, the requirements for the electrical connectors become higher, which require the electrical connector assembly to support rapid transmission velocity and to enhance the stability of the signal transmission of the electrical connectors.

An existing electrical connector is used to be electrically connected to a mating member, and includes an insulating body and a plurality of terminals provided in the insulating body. The insulating body has an insertion slot used to be inserted by the mating member. The insertion slot is formed by being concavely provided downward from a top surface of the insulating body. The insulating body is provided with two side walls at two opposite sides of the insertion slot. Each side wall has a plurality of accommodating slots. The terminals include a plurality of signal terminals and a plurality of ground terminals. The signal terminals and the ground terminals are correspondingly assembled upwardly into the accommodating slots. Each terminal is a thin and long structure. Each terminal has a fixing portion retained to the corresponding accommodating slot, and an elastic arm formed by obliquely extending upward from the fixing portion. The elastic arm has a contact portion protruding into the insertion slot. The contact portion is used to be in contact with the mating member to form electrical connection therebetween. A soldering portion is formed by extending downward from the fixing portion. The soldering portion is used to be soldered to a circuit board.

For convenience of assembly of the terminals, the accommodating slots are provided to be larger, thus resulting in air being filled in the space surrounding each of the terminals, and the dielectric coefficient of the surrounding environment of each signal terminal is small. Further, each signal terminal is a thin and long structure, which has a large inductive resistance and a small capacitive resistance, thus not satisfying the matching impedance of the signal terminal required for transmission of high frequency signals.

Therefore, a heretofore unaddressed need to design a novel electrical connector exists in the art to address the aforementioned deficiencies and inadequacies.

SUMMARY

In view of the deficiency of the background, the present invention is directed to an electrical connector, which is additionally provided with an insulating plug member close to the signal terminal, thus enhancing the dielectric coefficient of the surrounding environment of the signal terminal, adjusting the impedance of the signal terminal, and satisfying the matching impedance of the signal terminal required for transmission of high frequency signals.

To achieve the foregoing objective, the present invention adopts the following technical solutions.

An electrical connector is configured to be inserted with a mating member. The electrical connector includes: an insulating body, having a mating surface, wherein an insertion slot is concavely provided on the mating surface, a slot bottom surface is formed on a concave direction of the insertion slot, the insertion slot is configured to accommodate the mating member, the insulating body has two side walls located at two sides of the insertion slot, one of the two side walls is provided with at least one ground accommodating slot and at least one signal accommodating slot, and the signal accommodating slot and the ground accommodating slot are respectively in communication to the insertion slot; a plurality of terminals, provided on at least one of the two side walls, wherein each of the terminals has a contact portion protruding into the insertion slot and configured to be electrically connected to the mating member, the terminals comprise at least one signal terminal and at least one ground terminal, the signal terminal is correspondingly accommodated in the signal accommodating slot, and the ground terminal is correspondingly accommodated in the ground accommodating slot; and an insulating plug member, mounted to the insulating body, wherein a side of the insulating plug member facing the mating surface is provided with a first portion corresponding to each of the at least one signal accommodating slot, and a second portion corresponding to each of the at least one ground accommodating slot, the first portion is provided closer to the mating surface than the second portion, and the first portion is accommodated in the corresponding signal accommodating slot and is provided closer to the mating surface than the slot bottom surface.

In certain embodiments, each of the at least one signal terminal has a fixing portion retained to the corresponding signal accommodating slot, the first portion abuts the corresponding fixing portion in a direction away from the insertion slot, an elastic arm is formed by extending from the fixing portion toward the mating surface, and the contact portion is located on the elastic arm.

In certain embodiments, the first portion is provided with a protruding rib formed by protruding toward the corresponding fixing portion, and the protruding rib and the corresponding fixing portion are in interference fit.

In certain embodiments, each of the two side walls is provided with at least one signal accommodating slot and at least one ground accommodating slot arranged in a row, the terminals are provided in two rows on the two side walls respectively, each row of the terminals comprises at least one signal terminal and at least one ground terminal, the insulating plug member is provided with a plurality of first portions, and the first portions of the insulating plug member abut the fixing portions of the signal terminals in two rows to fix the insulating plug member.

In certain embodiments, each of the at least one signal terminal has a fixing portion retained to the corresponding signal accommodating slot, an elastic arm is formed by extending obliquely from the fixing portion toward the mating surface and the insertion slot, the contact portion is located on the elastic arm, the first portion has a first oblique surface, and the first oblique surface extends obliquely toward the mating surface and the insertion slot and is provided facing the corresponding elastic arm.

In certain embodiments, the insulating body is provided with a second oblique surface corresponding to each of the at least one signal accommodating slot, the second oblique surface extends obliquely toward the mating surface and the insertion slot, the elastic arm is located between the corresponding first oblique surface and the corresponding second oblique surface, and gaps exist respectively between the elastic arm and the corresponding first oblique surface and between the elastic arm and the corresponding second oblique surface.

In certain embodiments, the insulating body has a protruding portion protruding correspondingly toward each of the at least one signal accommodating slot, the protruding portion is formed by protruding toward the insertion slot, the protruding portion is provided closer to the mating surface than the corresponding first portion, and the protruding portion has the second oblique surface.

In certain embodiments, the second oblique surface and the corresponding first oblique surface are parallel to each other.

In certain embodiments, the first portion has a first surface facing the insertion slot, and the first surface is provided to be recessed relative to a slot wall of the insertion slot.

In certain embodiments, the terminals on the one of the side walls are arranged along a longitudinal direction, each of the at least one signal accommodating slot has two slot walls provided opposite to each other in the longitudinal direction, and a gap exists between each of the two slot walls of the signal accommodating slot and the corresponding first portion in the longitudinal direction.

In certain embodiments, the one of the two side walls is provided with two adjacent signal accommodating slots and two ground accommodating slots, the two adjacent signal accommodating slots are located between the two ground accommodating slots, two signal terminals accommodated in the two adjacent signal accommodating slots are configured to transmit differential signals.

In certain embodiments, each of the two side walls is provided with at least one signal accommodating slot and at least one ground accommodating slot arranged in a row, the insulating body has a partition extending from the slot bottom surface toward a direction away from the mating surface, the partition separates the two rows of the signal accommodating slot and the ground accommodating slot on the two side walls from each other, and a gap exists between the first portion and the partition.

In certain embodiments, the second portion is provided farther away from the mating surface than the slot bottom surface.

In certain embodiments, the second portion is completely located at an outer side of one end of the corresponding ground accommodating slot away from the mating surface.

In certain embodiments, the insulating body has a protruding portion protruding correspondingly toward each of the at least one signal accommodating slot, the protruding portion is formed by protruding toward the insertion slot, the protruding portion is provided closer to the mating surface than the corresponding first portion, each of the at least one signal terminal has a fixing portion retained to the corresponding signal accommodating slot, an elastic arm is formed by extending obliquely from the fixing portion toward the mating surface and the insertion slot, the contact portion is located on the elastic arm, and the protruding portion is provided to be close to the mating surface relative to the corresponding elastic arm.

In certain embodiments, the at least one signal accommodating slot and the at least one ground accommodating slot on the one of the side walls are arranged along a longitudinal direction, each of the at least one signal accommodating slot has two slot walls provided opposite to each other in the longitudinal direction, and the protruding portion connects the two slot walls of the corresponding signal accommodating slot.

In certain embodiments, each of the at least one signal accommodating slot runs through the mating surface, the insulating body is provided with a pre-pressurized block in each of the at least one signal accommodating slot, the pre-pressurized block is provided closer to the mating surface relative to the corresponding protruding portion and adjacent to the insertion slot, the protruding portion extends toward the insertion slot and does not pass beyond a side edge of the corresponding pre-pressurized block away from the insertion slot, each of the at least one signal terminal is provided with a pre-pressurized arm formed by extending from the contact portion toward the mating surface, and the pre-pressurized arm abuts the corresponding pre-pressurized block prior to the mating member being inserted into the insertion slot.

In certain embodiments, the insulating body has a foolproof portion located in the insertion slot, the foolproof portion is formed by extending from the slot bottom surface toward the mating surface, the foolproof portion divides the insertion slot into a long slot and a short slot having different lengths in a longitudinal direction, and the insulating plug member is mounted on a side of the insulating body corresponding to the long slot and away from the mating surface.

In certain embodiments, each of the terminals has a fixing portion and an elastic arm formed by extending from the fixing portion, the contact portion is provided on the elastic arm, the fixing portion of each of the at least one ground terminal retains to the corresponding ground accommodating slot, the fixing portion of each of the at least one signal terminal retains to the corresponding signal accommodating slot, the one of the two side walls is provided with a plurality of notches corresponding to the fixing portions of the terminals, each of the notches is connected to a corresponding one of the fixing portions of the terminals and runs outward through the corresponding side wall in a direction away from the insertion slot, a side of the one of the two side walls away from the insertion slot is covered by a metal member, the metal member is provided with at least one abutting arm extending toward a direction away from the mating surface, and the abutting arm passes through the notch corresponding to the fixing portion of the ground terminal and abuts the fixing portion of the ground terminal.

In certain embodiments, the metal member has a strengthening portion, the strengthening portion is a protrusion formed on the metal member toward the direction away from the insertion slot, and the strengthening portion is provided closer to the mating surface relative to the abutting arm.

In certain embodiments, the metal member shields the notches corresponding to the fixing portions of the signal terminals on the corresponding side wall.

Compared with the related art, the electrical connector according to certain embodiments of the present invention has the following beneficial effects.

By additionally providing the insulating plug member, the insulating plug member is provided with a first portion corresponding to the signal accommodating slot and a second portion corresponding to the ground accommodating slot. The first portion is provided closer to the mating surface of the insulating body than the second portion. That is, the change to the dielectric coefficient of the surrounding environment of the signal terminal by the insulating plug member is greater than the change to the dielectric coefficient of the surrounding environment of the ground terminal. Such configuration may be used to adjust the impedance of the signal terminal, and to satisfy the matching impedance of the signal terminal required for transmission of high frequency signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
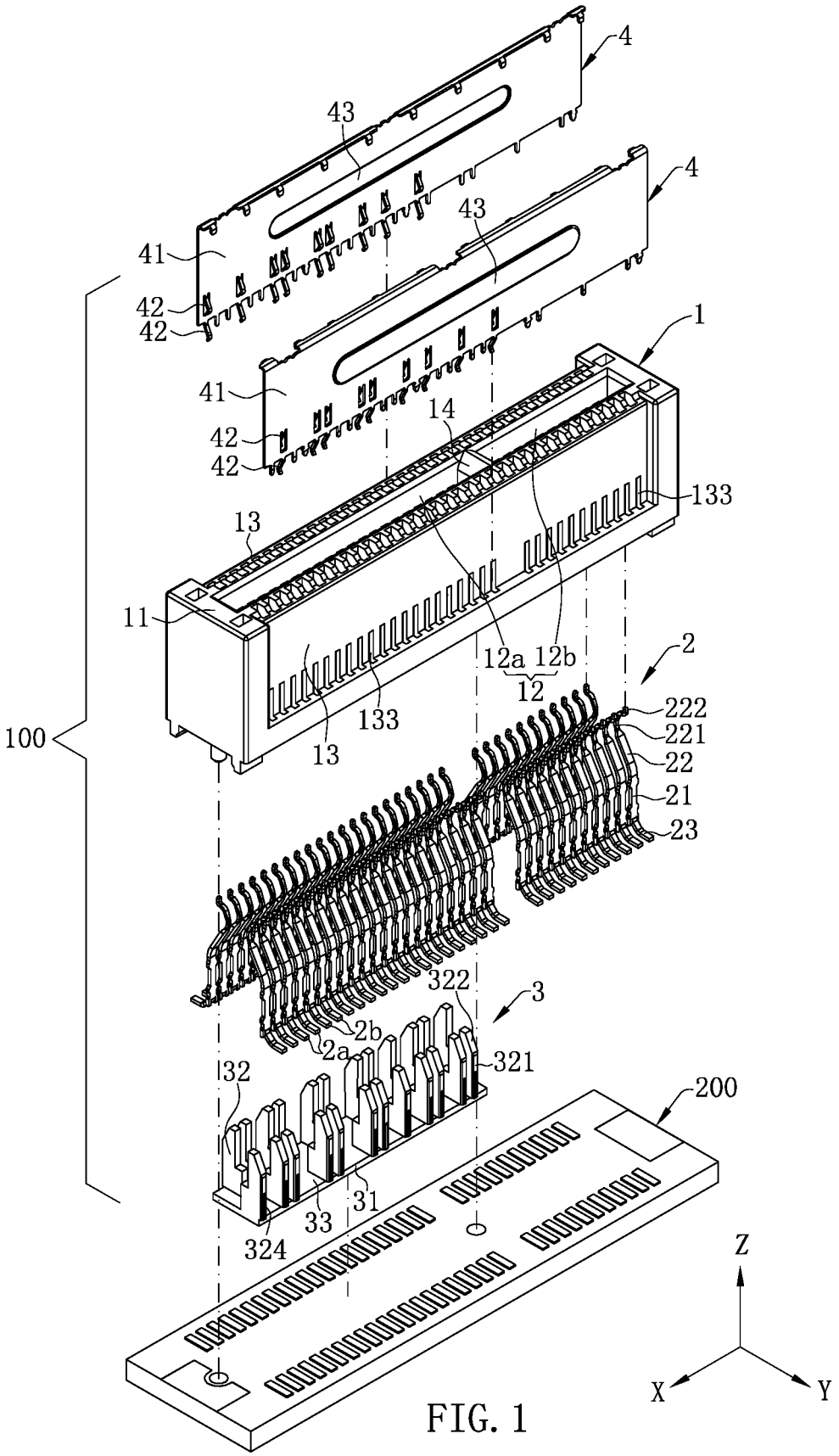
FIG. 1 is a perspective exploded view of an electrical connector and a circuit board according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to an electrical connector.

Figure 5:
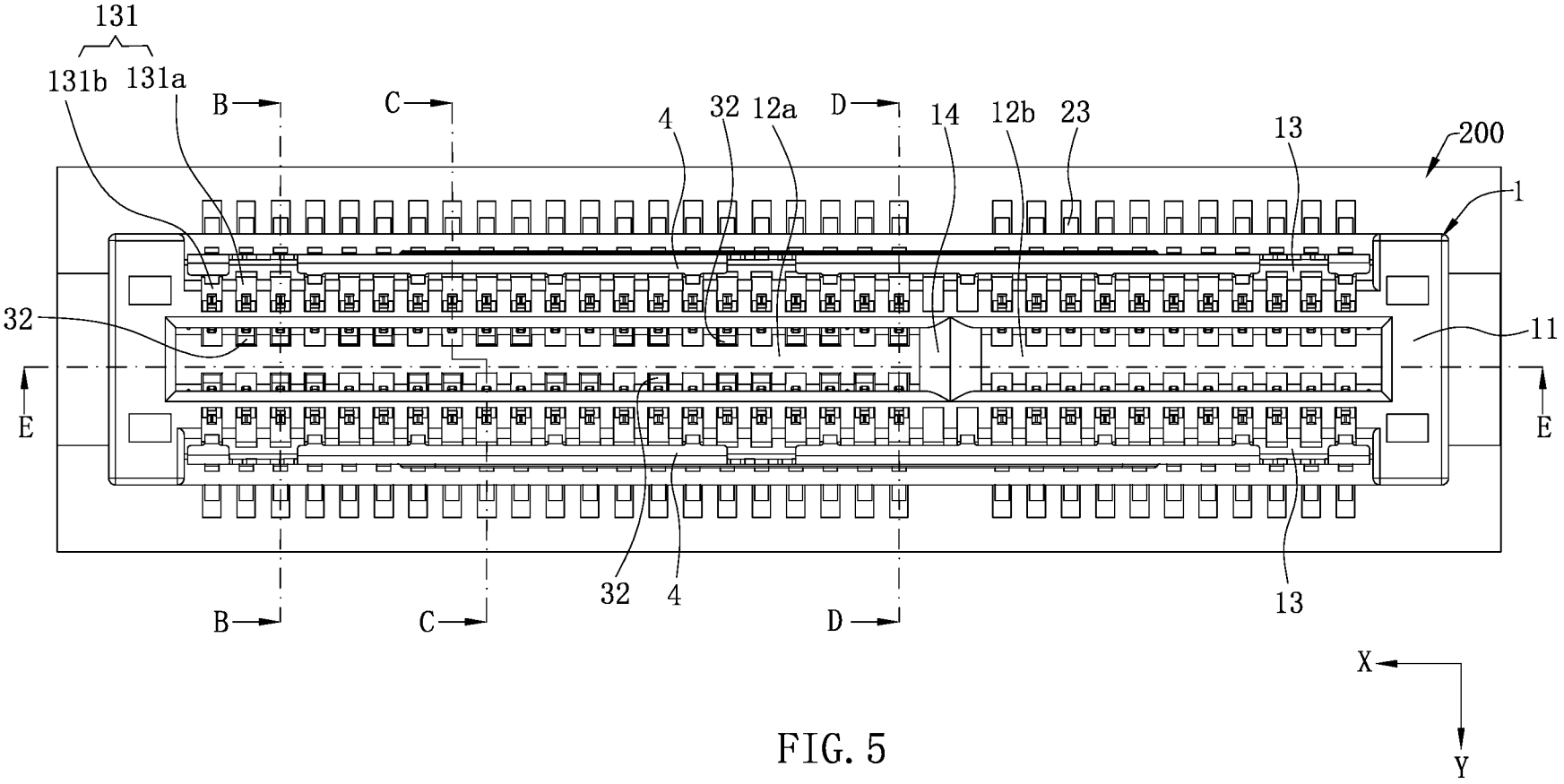
FIG. 5 is a top view of FIG. 3.
Figure 6:
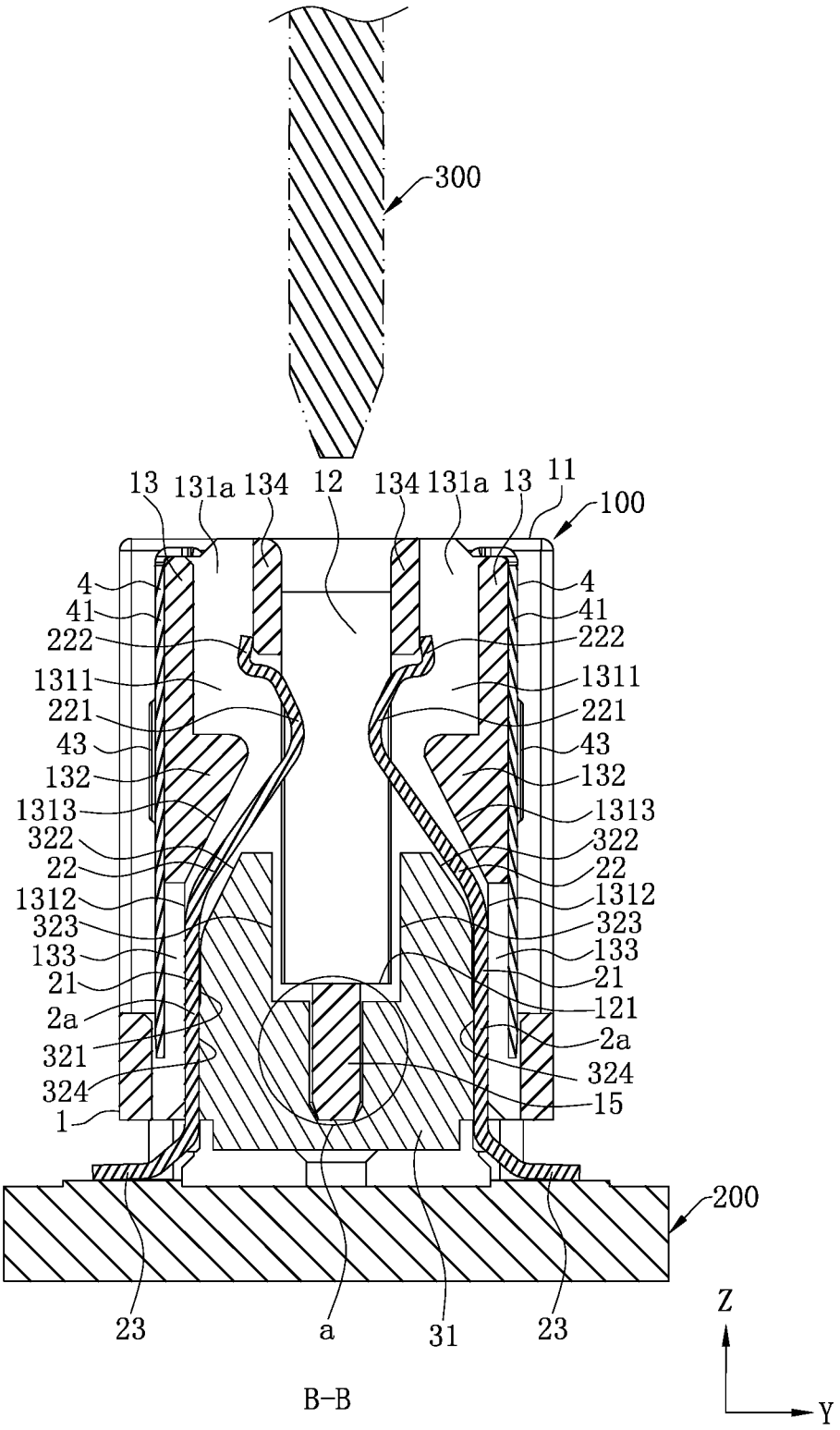
FIG. 6 is a schematic view of FIG. 5 sectioned along a line B-B without being inserted with the mating member.

FIG. 1, FIG. 5 and FIG. 6 show an electrical connector 100 according to certain embodiments of the present invention. The electrical connector 100 is mounted on a circuit board 200, and is used to be inserted with a mating member 300. For example, the mating member 300 is an electronic card. To conveniently describe the specific structures of the electrical connector 100, a longitudinal direction X, a left-right direction Y and a front-rear direction Z are defined, and each two of the longitudinal direction X, the left-right direction Y and the front-rear direction Z are perpendicular to each other. In this embodiment, the electrical connector 100 is mounted backward to the circuit board 200.

Figure 4:
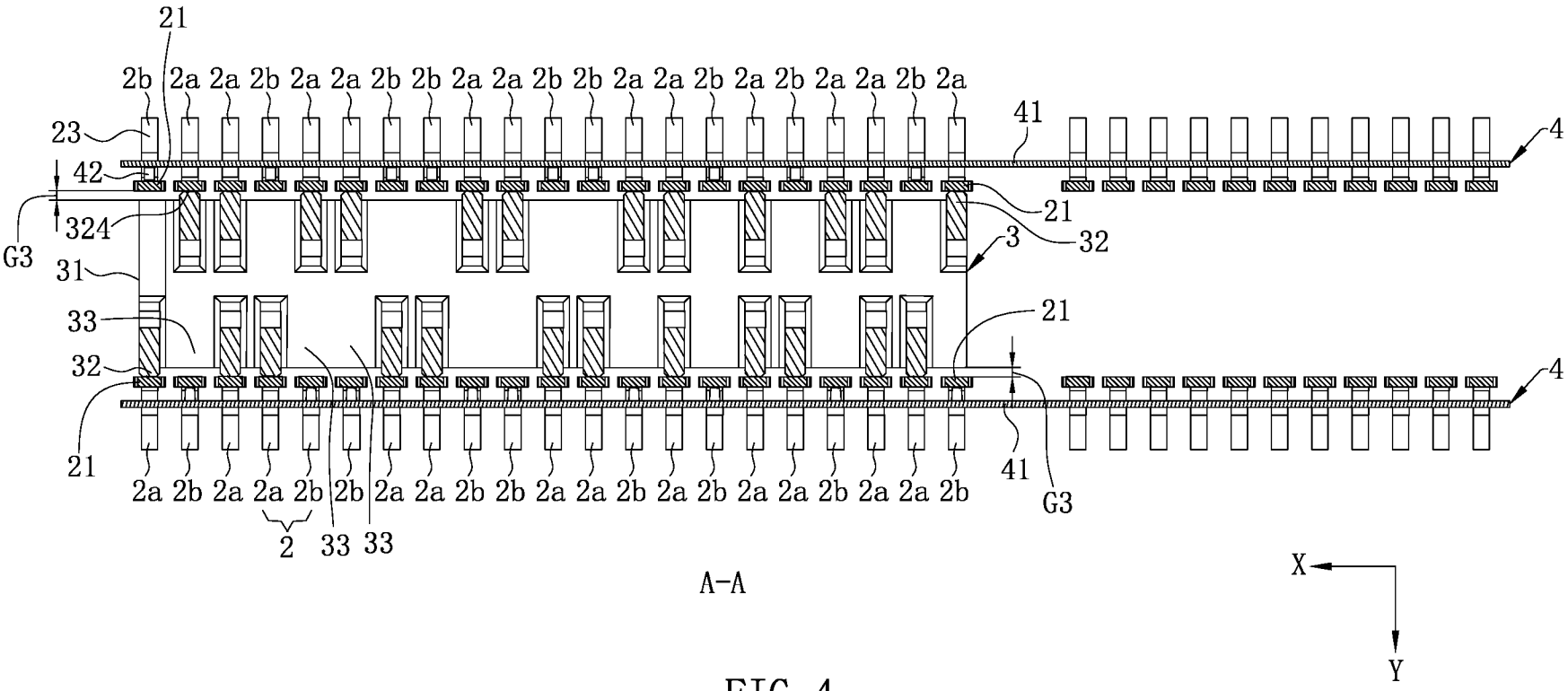
FIG. 4 is a schematic view of FIG. 3 sectioned along a line A-A and only showing the terminals, the insulating plug member and the metal member.

As shown in FIG. 1 and FIG. 4, the electrical connector 100 includes an insulating body 1, a plurality of terminals 2 provided in the insulating body 1, an insulating plug member 3 mounted on the insulating body 1, and two metal members 4 shielded outside the insulating body 1.

Figure 3:
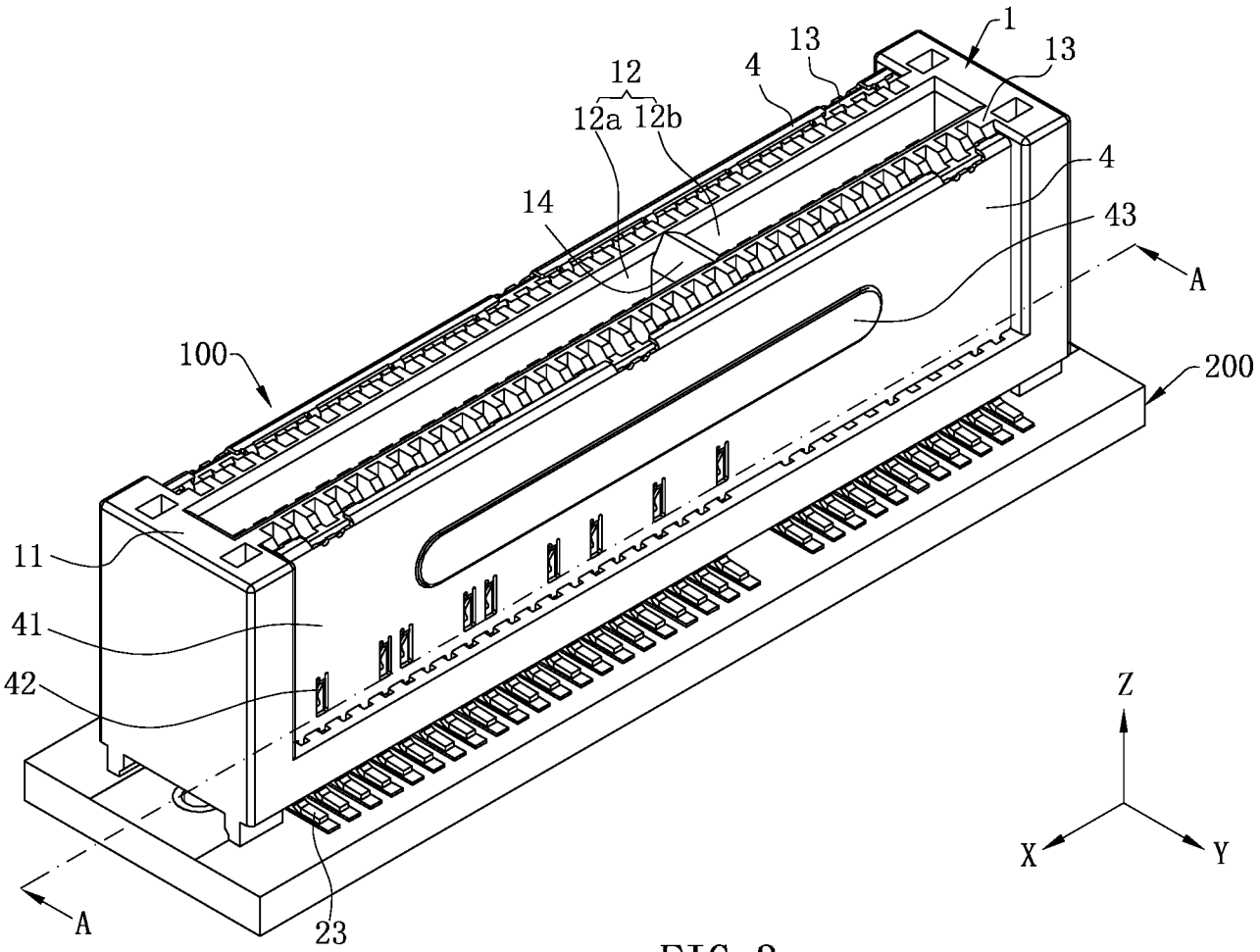
FIG. 3 is a perspective assembled view of the electrical connector and the circuit board in FIG. 1.

As shown in FIG. 1, FIG. 3 and FIG. 6, the insulating body 1 has a mating surface 11 at its front end. In this embodiment, the front end surface of the insulating body 1 serves as the mating surface 11. The insulating body 1 has an insertion slot 12 formed by recessing backward from the mating surface 11, and two side walls 13 located at two opposite sides of the insertion slot 12. The two side walls 13 are provided at an interval in the left-right direction Y. The insertion slot 12 extends along the longitudinal direction X, and is used for the mating member 300 to insert backward therein. The insertion slot 12 has a slot bottom surface 121 at its back end.

Figure 13:
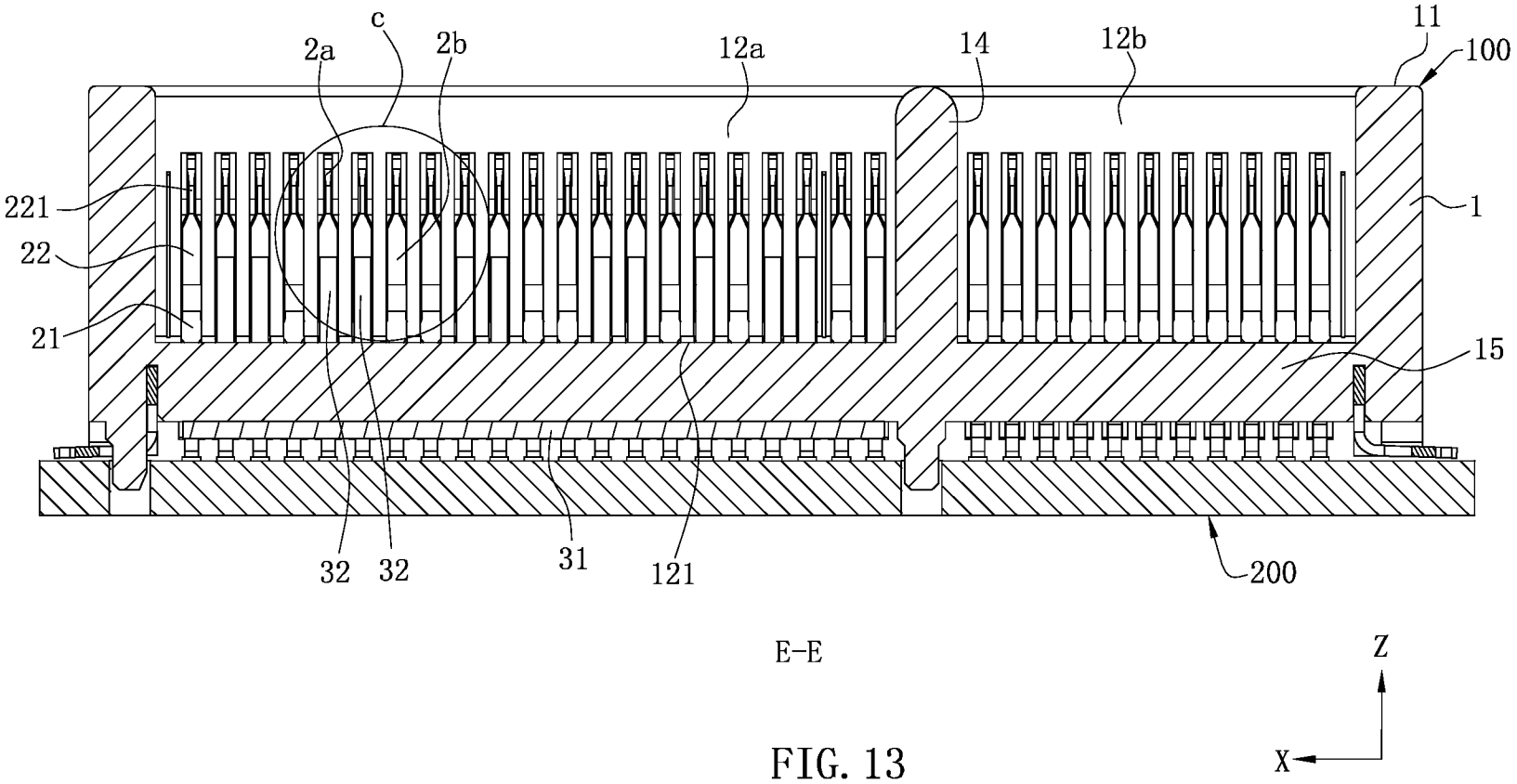
FIG. 13 is a sectional view of FIG. 5 along a line E-E.

As shown in FIG. 3, FIG. 5 and FIG. 13, the insulating body 1 has a foolproof portion 14 located in the insertion slot 12 and connecting the two side walls 13. The foolproof portion 14 is formed by extending from the slot bottom surface 121 toward the mating surface 11. The foolproof portion 14 and the side walls 13 are injection-molded. The foolproof portion 14 divides the insertion slot 12 into a long slot 12*a* and a short slot 12*b* having different lengths in the longitudinal direction X.

Figure 15:
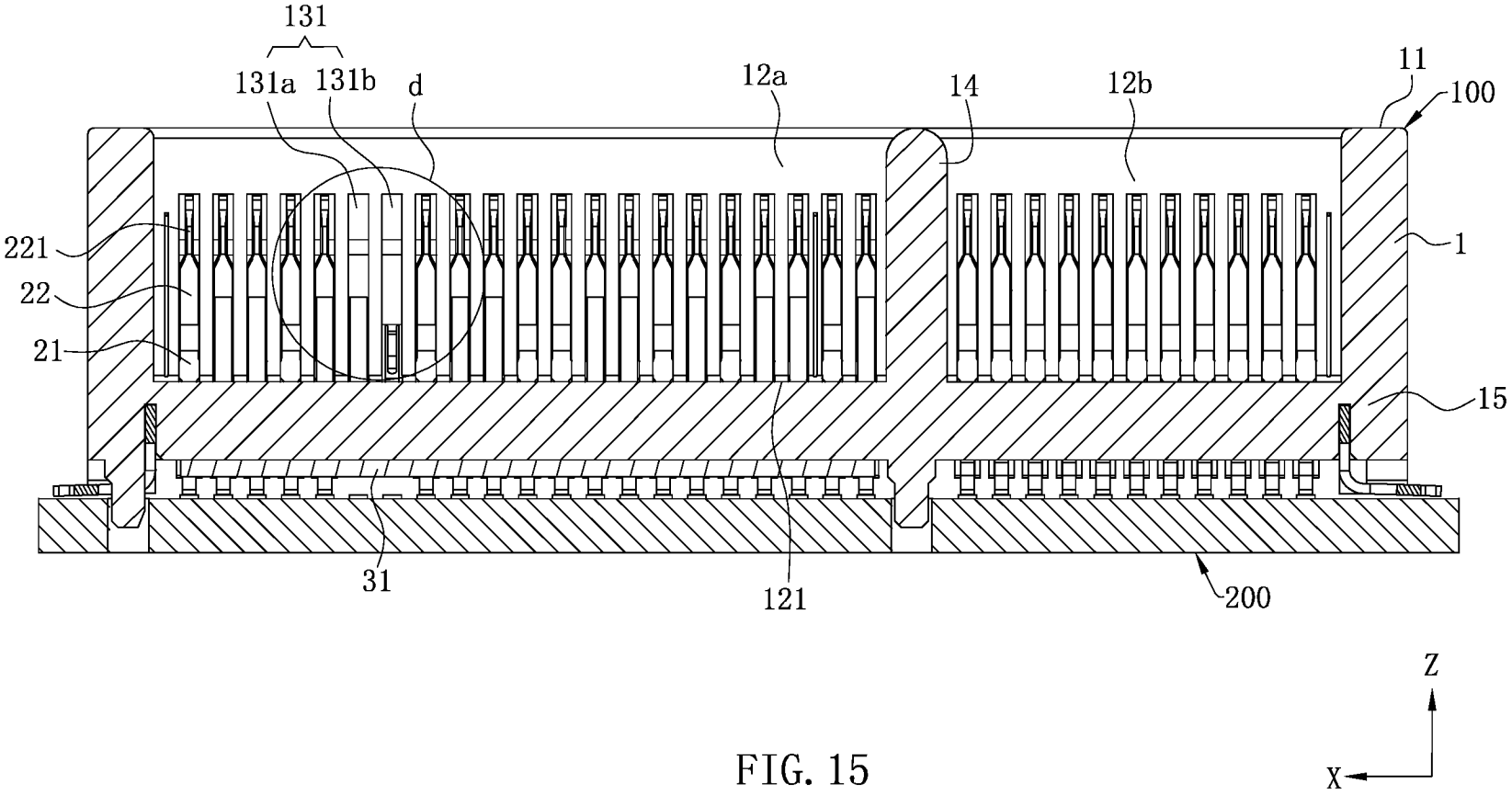
FIG. 15 is a schematic view of FIG. 13 with a signal terminal and a ground terminal being hidden.
Figure 16:
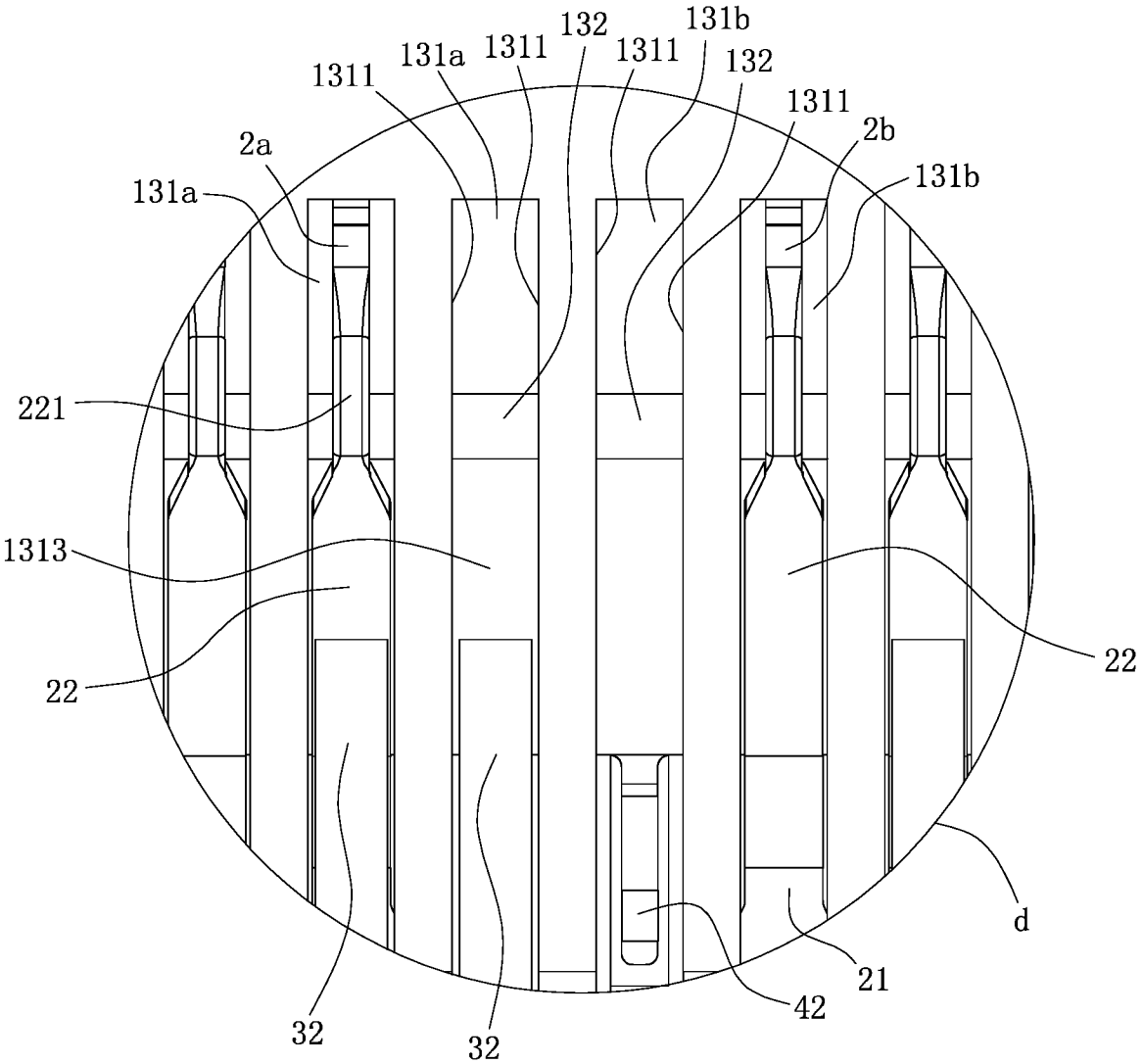
FIG. 16 is an enlarged view of a portion din FIG. 15.

As shown in FIG. 5, FIG. 15 and FIG. 16, each side wall 13 is provided with a plurality of accommodating slots 131 arranged in a row along the longitudinal direction X. The accommodating slots 131 include a plurality of signal accommodating slots 131*a* and a plurality of ground accommodating slots 131*b*. Each of the signal accommodating slots 131*a* and the ground accommodating slots 131*b* has two slot walls 1311 provided opposite to each other in the longitudinal direction X, and each of the signal accommodating slots 131*a* and the ground accommodating slots 131*b* is in communication with the insertion slot 12 in the left-right direction Y and runs through the corresponding side wall 13 in the front-rear direction Z respectively. The accommodating slots 131 has a plurality of signal accommodating slots 131*a* provided in pairs, and a plurality of ground accommodating slots 131*b* provided in pairs, and the signal accommodating slots 131*a* in pairs and the ground accommodating slots 131*b* in pairs are arranged alternately along the longitudinal direction X. In this embodiment, the structures of the signal accommodating slots 131*a* and the ground accommodating slots 131*b* on the same side wall 13 are identical, and the signal accommodating slots 131*a* in pairs on one of the two side walls 13 and the ground accommodating slots 131*b* in pairs on the other of the two side walls 13 are provided symmetrically in the left-right direction.

Figure 10:
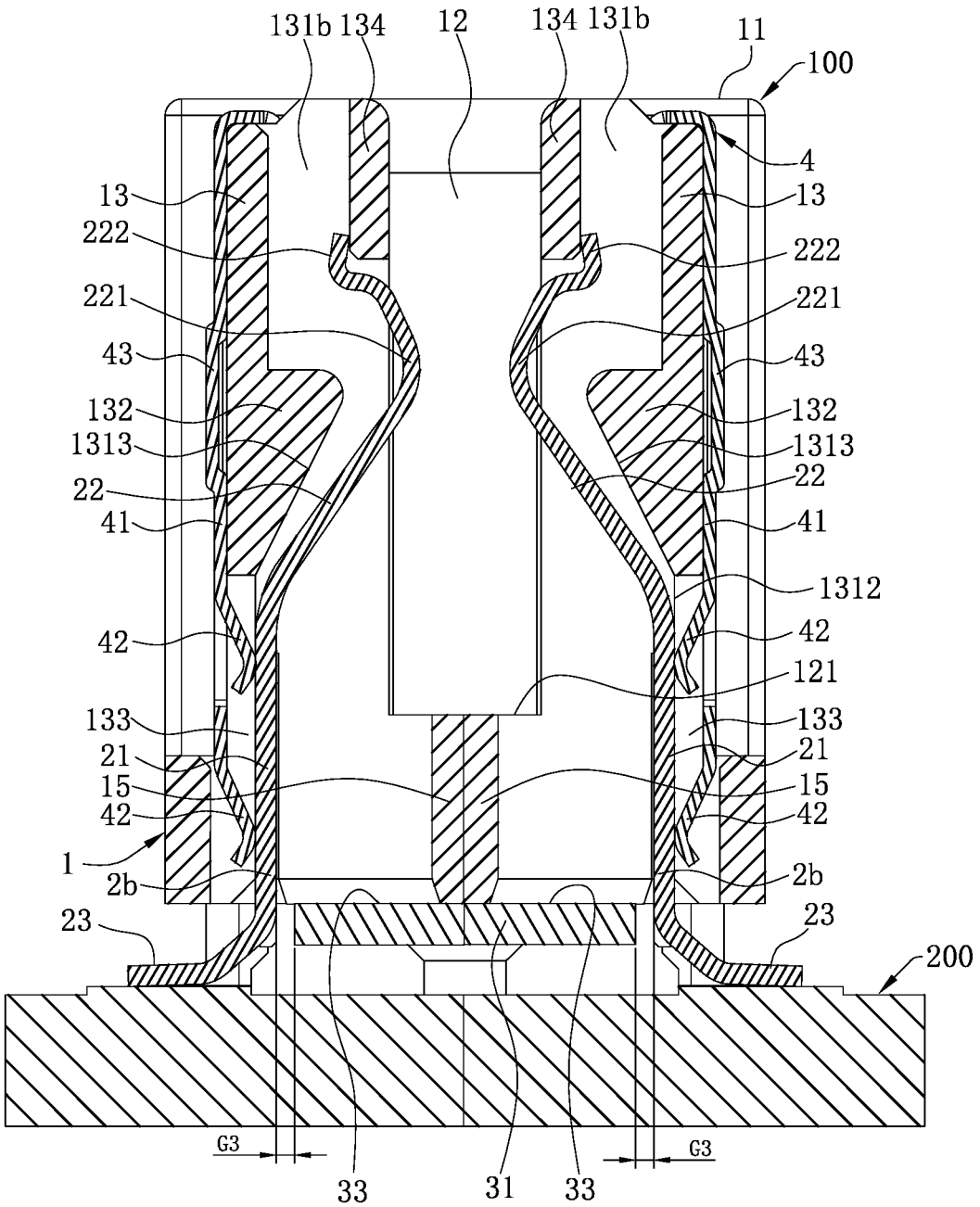
FIG. 10 is a sectional view of FIG. 5 along a line C-C.

As shown in FIG. 6 and FIG. 10, the insulating body 1 has a partition 15. The partition 15 extends from the slot bottom surface 121 toward a direction away from the mating surface 11, and separates the two rows of the accommodating slots 131 on the two side walls 13 from each other. A portion of each signal accommodating slot 131*a* and a portion of each ground accommodating slot 131*b* are located behind the slot bottom surface 121.

As shown in FIG. 6 and FIG. 10, each side wall 13 of the insulating body 1 has a plurality of protruding portions 132 protruding toward the signal accommodating slots 131*a* and the ground accommodating slots 131*b* respectively. In other words, one protruding portion 132 is provided in each signal accommodating slot 131*a*, and one protruding portion 132 is provided in each ground accommodating slot 131*b*. Each protruding portion 132 is formed by protruding toward the insertion slot 12 in the left-right direction Y. In this embodiment, each protruding portion 132 is located in front of the slot bottom surface 121 in the front-rear direction Z.

Figure 12:
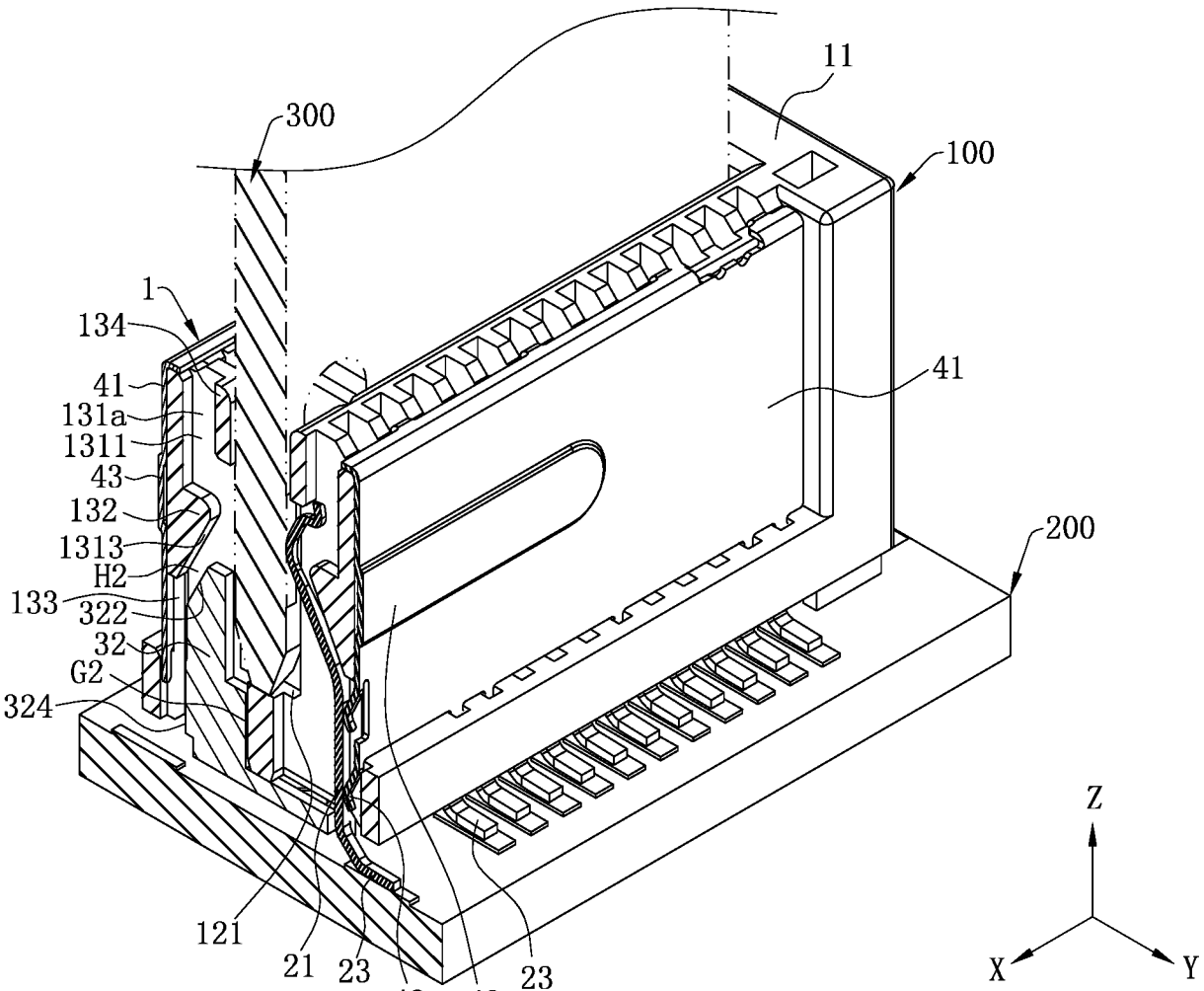
FIG. 12 is perspective view of FIG. 11.

As shown in FIG. 12 and FIG. 16, each protruding portion 132 connects the two slot walls 1311 of the corresponding signal accommodating slot 131*a* or the two slot walls 1311 of the corresponding signal accommodating slot 131*b* in the longitudinal direction X.

Figure 11:
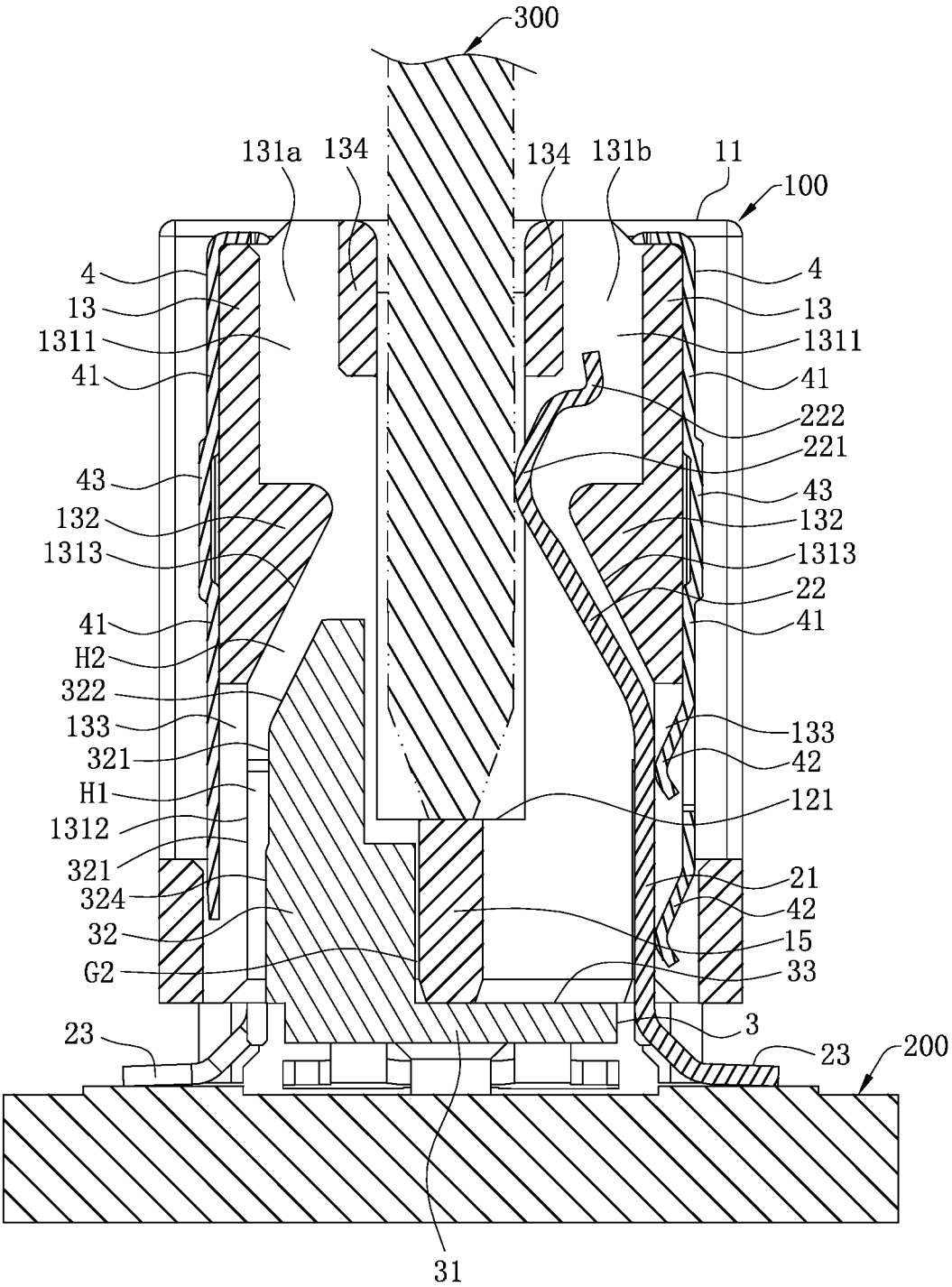
FIG. 11 is a schematic view of FIG. 5 sectioned along a line D-D with a signal terminal being hidden.
Figure 11:
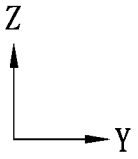

As shown in FIG. 11 and FIG. 12, each signal accommodating slot 131*a* has a first wall 1312 and a second wall 1313 located at a front end of the first wall 1312. The first wall 1312 extends along the front-rear direction Z, and connects the two slot walls 1311 of the corresponding signal accommodating slot 131*a*. The first wall 1312 is located at a side of the corresponding signal accommodating slot 131*a* away from the insertion slot 12 in the left-right direction Y. The second wall 1313 is located on the corresponding protruding portion 132, and the second wall 1313 extends obliquely toward the mating surface 11 and the insertion slot 12.

As shown in FIG. 1, FIG. 6 and FIG. 10, each side wall 13 is provided with a plurality of notches 133. Each signal accommodating slot 131*a* is in communication with one of the notches 133, and each ground accommodating slot 131*b* is in communication with one of the notches 133. Each notch 133 is located at a side of the corresponding signal accommodating slot 131*a* and the corresponding ground accommodating slot 131*b* away from the insertion slot 12 in the left-right direction Y, and each notch 133 runs outward through the corresponding side wall 13 in the left-right direction Y and partially runs backward through the corresponding side wall 13.

As shown in FIG. 6 and FIG. 10, the insulating body 1 is provided with a plurality of pre-pressurized blocks 134 in the signal accommodating slots 131*a* and the ground accommodating slots 131*b* respectively. In other words, one pre-pressurized block 134 is provided in each signal accommodating slot 131*a*, and one pre-pressurized block 134 is provided in each ground accommodating slot 131*b*. Each pre-pressurized block 134 is provided closer to the mating surface 11 than the corresponding protruding portion 132 and is adjacent to the insertion slot 12. Each protruding portion 132 extends toward the insertion slot 12 and does not pass beyond a side edge of the corresponding pre-pressurized block 134 away from the insertion slot 12.

As shown in FIG. 1 and FIG. 4, the terminals 2 include at least one signal terminal 2*a* and at least one ground terminal 2*b*. The structures and sizes of the signal terminal 2*a* and the ground terminal 2*b* are identical. In this embodiment, a plurality of signal terminals 2*a* and a plurality of ground terminals 2*b* are provided.

Figure 14:
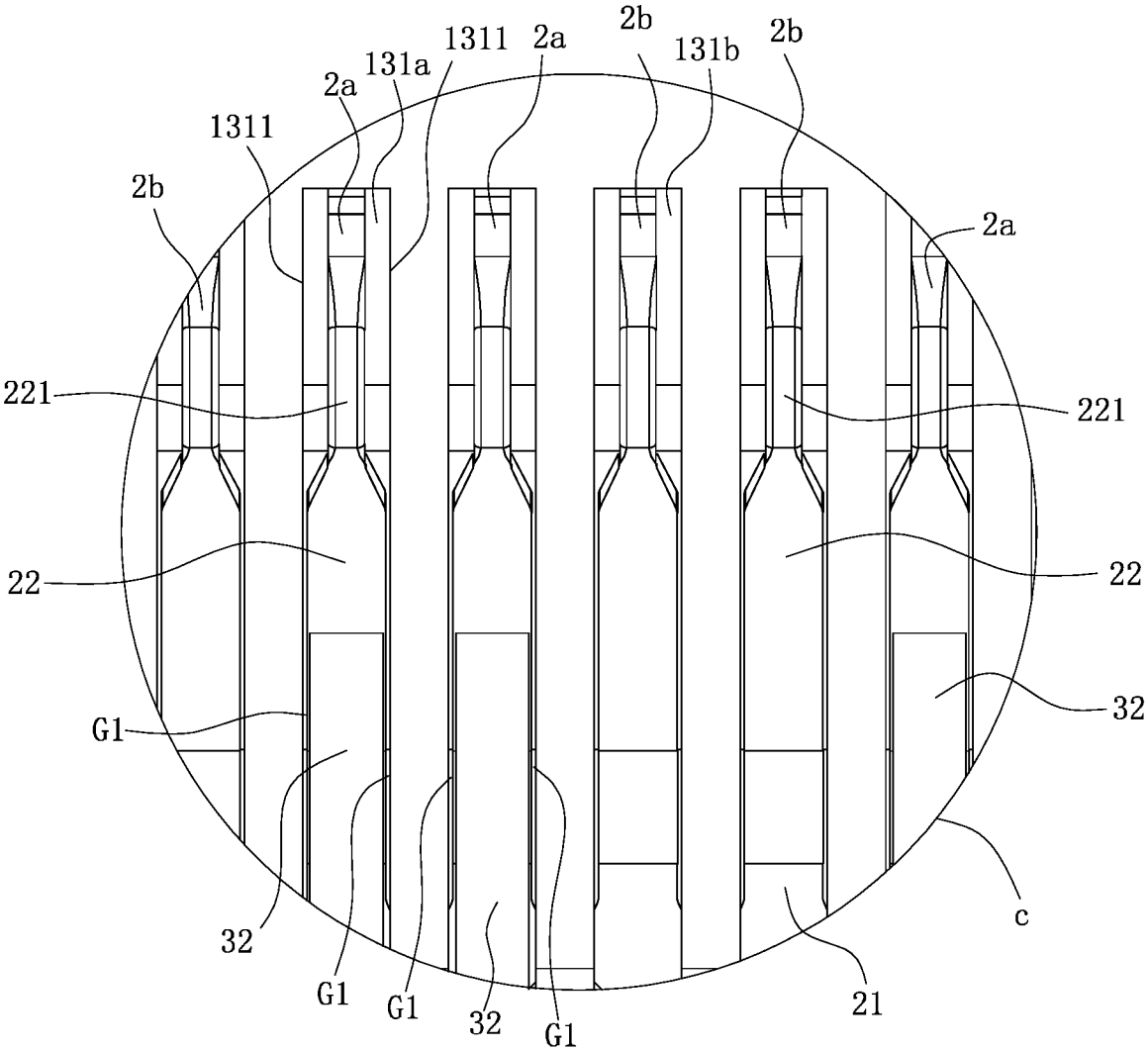
FIG. 14 is an enlarged view of a portion c in FIG. 13.

As shown in FIG. 1, FIG. 13 and FIG. 14, each signal accommodating slot 131*a* correspondingly accommodates a signal terminal 2*a*, and each ground accommodating slot 131*b* correspondingly accommodates a ground terminal 2*b*. The two signal terminals 2*a* accommodated in the two adjacent signal accommodating slots 131*a* are used to transmit differential signals.

As shown in FIG. 6 and FIG. 10, each terminal 2 has a fixing portion 21, an elastic arm 22 formed by obliquely extending from the fixing portion 21 toward the mating surface 11 and the insertion slot 12, and a soldering portion 23 formed by extending backward from the fixing portion 21. The elastic arm 22 is provided with a contact portion 221. The contact portion 221 protrudes into the insertion slot 12 to be in contact with the mating member 11 to form electrical connection therebetween. The fixing portion 21 of each signal terminal 2*a* is retained in a corresponding signal accommodating slot 131*a*, and the fixing portion 21 of each ground terminal 2*b* is retained in a corresponding ground accommodating slot 131*b*. The second wall 1313 faces the elastic arm 22. A tail end of the elastic arm 22 is provided with a pre-pressurized portion 222. The pre-pressurized portion 222 abuts a corresponding pre-pressurized block 134 prior to the mating member 300 being inserted into the insertion slot 12. Such design allows the depths of the contact portions 221 of the terminals 2 protruding into the insertion slot 12 to maintain consistent. The soldering portion 23 extends backward out of the insulating body 1 to be soldered to the circuit board 200 to form electrical connection therebetween.

Figure 2:
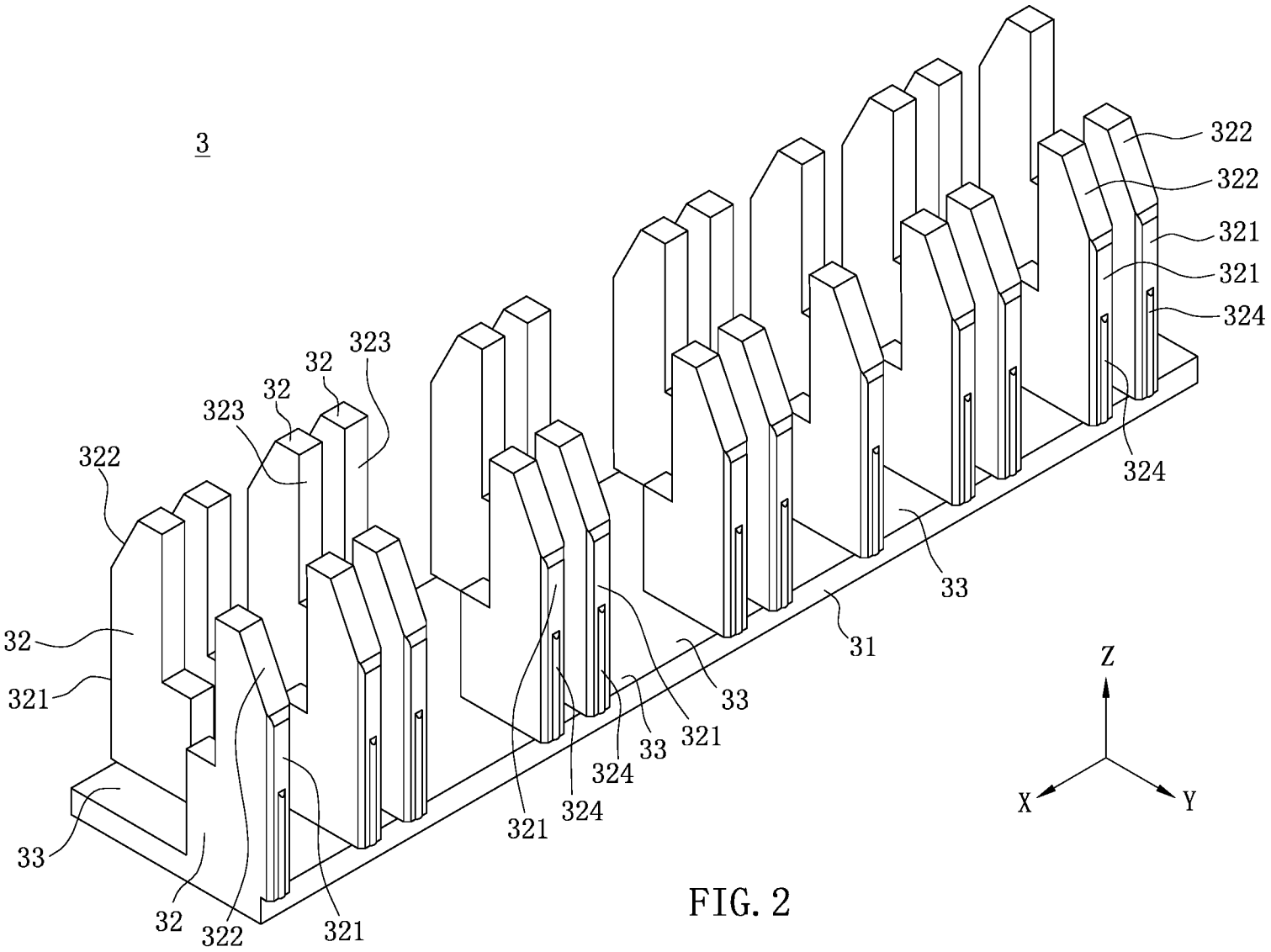
FIG. 2 is a perspective view of an insulating plug member in FIG. 1.
Figure 7:
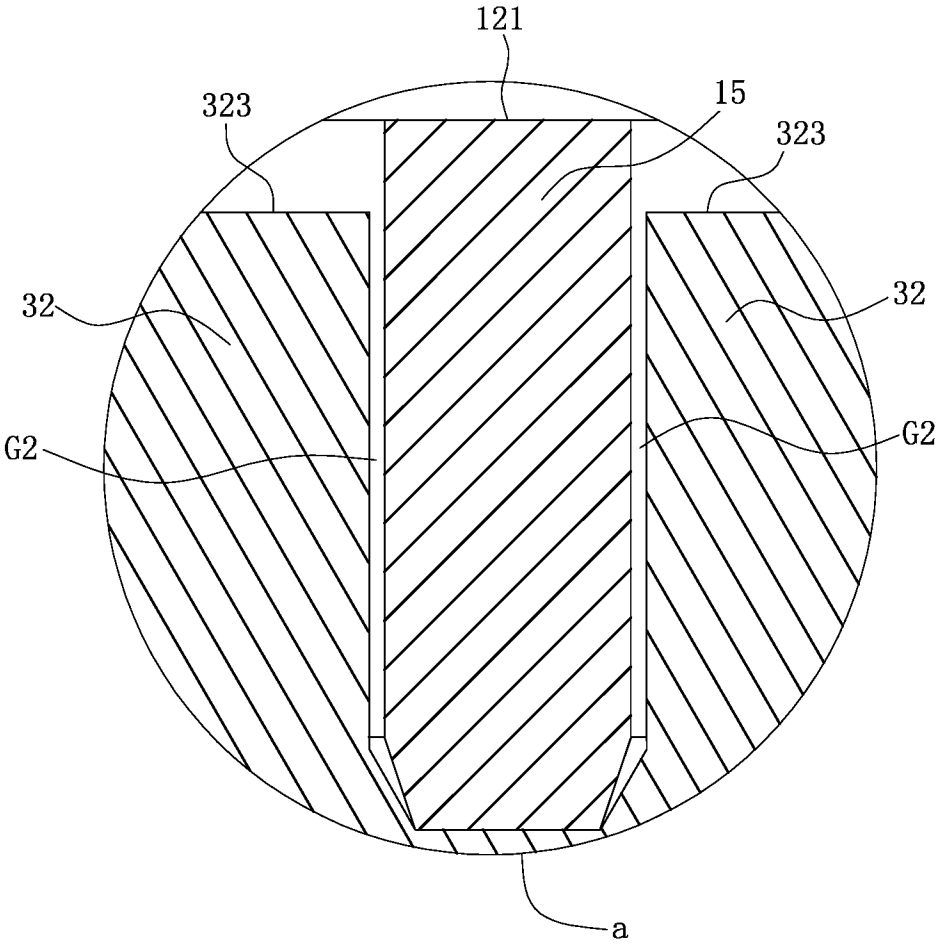
FIG. 7 is an enlarged view of a portion a in FIG. 6.

As shown in FIG. 2, FIG. 12 and FIG. 13, the insulating plug member 3 is mounted to the insulating body 1 corresponding to the location of the long slot 12*a* forward from back thereof. As shown in FIG. 6 and FIG. 7, the insulating plug member 3 has a base portion 31, and the base portion 31 abuts the partition 15 along a direction toward the mating surface 11. That is, the base portion 31 upwardly abuts the partition 15. The base portion 31 is provided to correspond to the location of the long slot 12*a*, and a length of the base portion 31 along the longitudinal direction X is substantially equal to a length of the long slot 12*a* in the longitudinal direction X. A plurality of first portions 32 are formed by extending forward from the base portion 31. Each signal accommodating slot 131*a* correspondingly accommodates one of the first portions 32. A front end of each first portion 32 is closer to the mating surface 11 than the slot bottom surface 121. In other words, each first portion 32 is provided to partially pass beyond the slot bottom surface 121. As shown in FIG. 4, FIG. 5 and FIG. 6, the terminals 2 are provided in two rows on the two side walls 12. In each row of the terminals 2, the first portion 32 is provided to be located closer to the fixing portion 21 of the corresponding signal terminal 2*a* than the base portion 31 in the left-right direction Y.

As shown in FIG. 5 and FIG. 16, in the longitudinal direction, a first gap G1 exists between each first portion 32 and the two slot walls 131 of the corresponding signal accommodating slot 131*a*.

As shown in FIG. 6 and FIG. 7, a second gap G2 exists between each first portion 32 and the partition 15 in the left-right direction Y, allowing each first portion 32 to be smoothly inserted into the corresponding signal accommodating slot 131*a*.

As shown in FIG. 2, FIG. 6 and FIG. 11, each first portion 32 has a third wall 321 and a fourth wall 322 located at a front end of the third wall 321. The third wall 321 extends along the front-rear direction Z, and the fourth wall 322 extends obliquely toward the mating surface 11 and the insertion slot 12. In this embodiment, the second wall 1313 and the fourth wall 322 are provided to be parallel to each other, the fourth wall 322 is defined as a first oblique surface 322, and the second wall 1313 is defined as a second oblique surface 1313. The second wall 1313 is at least partially located at a front end of the fourth wall 322. The first wall 1312 and the third wall 321 are opposite to each other in the left-right direction, forming a first channel H1 therebetween. A second channel H2 is formed between the second wall 1313 and the fourth wall 322. The second channel H2 is in backward communication with the corresponding first channel H1. The fixing portion 21 of each signal terminal 2*a* is accommodated in the corresponding first channel H1, and the elastic arm 22 of each signal terminal 2*a* is accommodated in the corresponding second channel H2. Gaps exist between the first oblique surface 322 and the elastic arm 22 and between the second oblique surface 1313 and the elastic arm 22 respectively, thus providing reserved spaces for the elastic arm 22 to elastically deform when being applied with a force.

Figure 8:
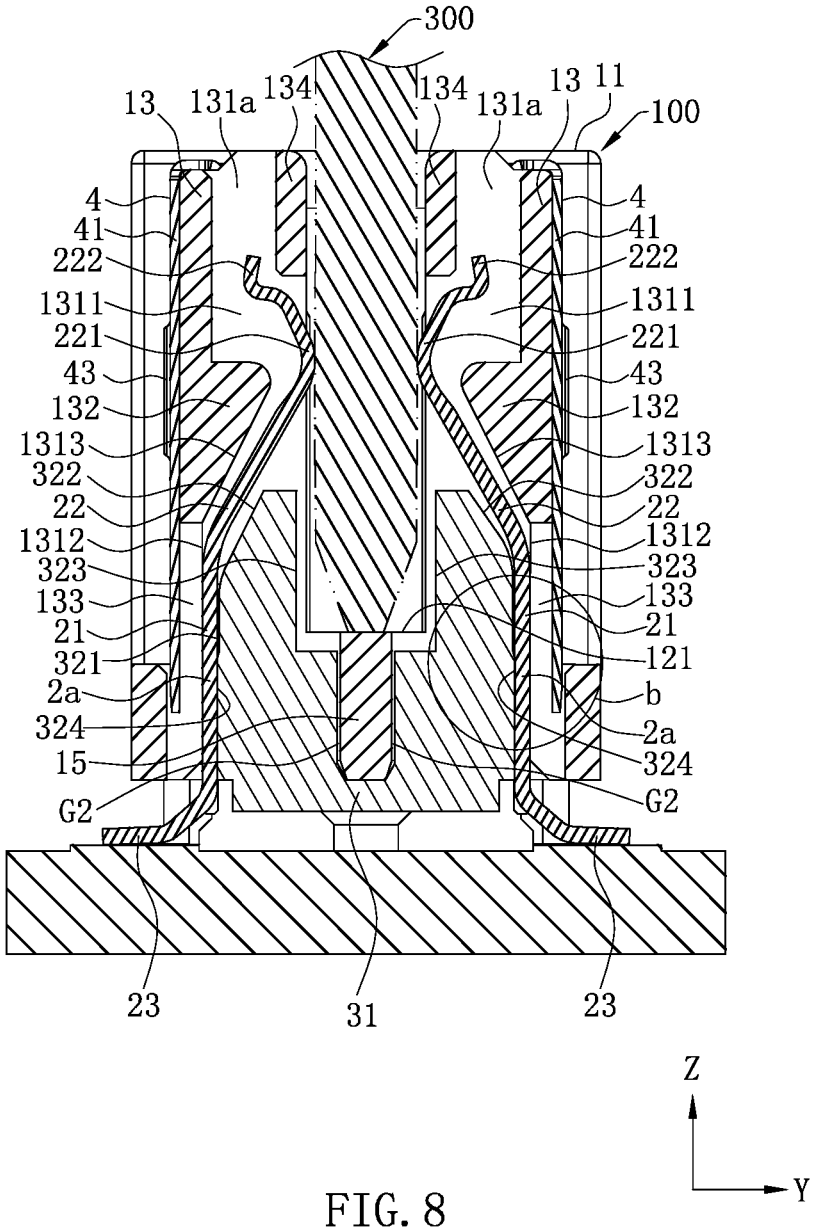
FIG. 8 is a schematic view of FIG. 6 being inserted with the mating member.

As shown in FIG. 6 and FIG. 8, each first portion 32 has a first surface 323 facing the insertion slot 12. The first surface 323 is provided to be recessed relative to a corresponding slot wall of the insertion slot 12, thus preventing each first portion 32 from protruding into the insertion slot 12 and affecting the insertion of the mating member 300 and the electrical connection between the mating member 300 and the contact portion 221.

Figure 9:
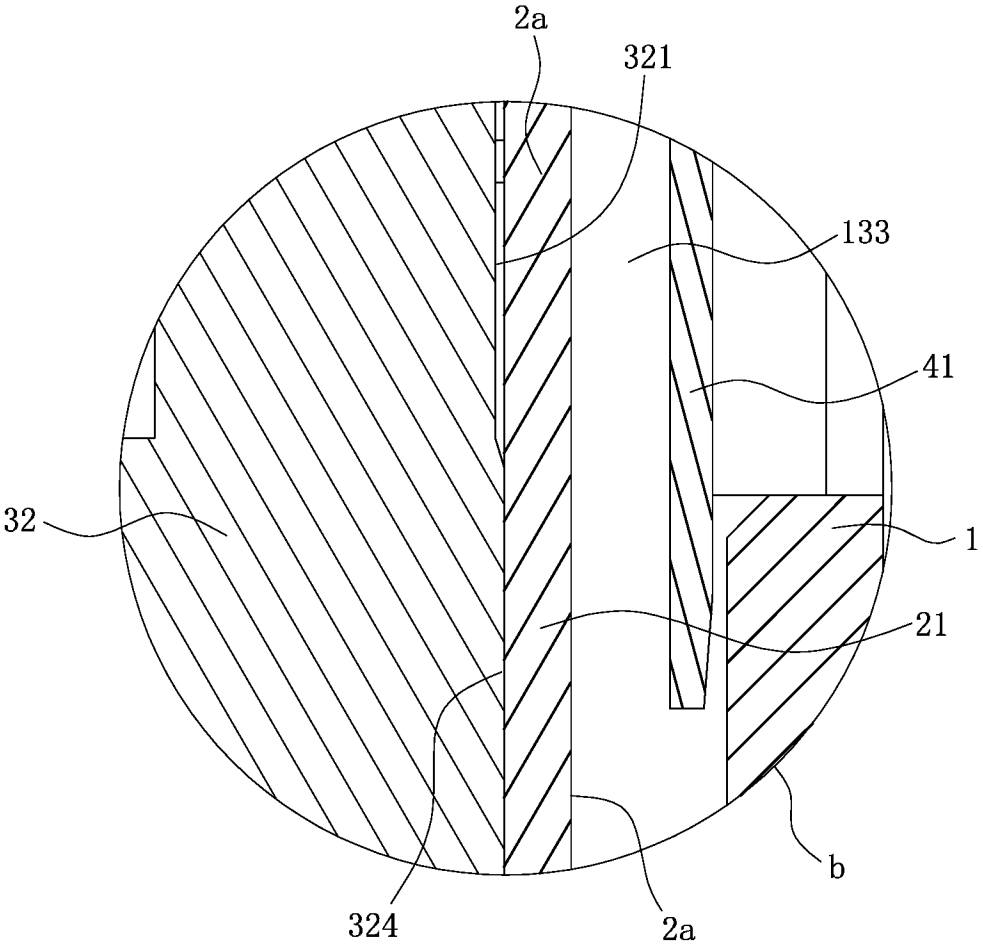
FIG. 9 is an enlarged view of a portion b in FIG. 8.

As shown in FIG. 2, FIG. 8 and FIG. 9, each first portion 32 is provided with a protruding rib 324 protruding from the third wall 321 toward the direction away from the insertion slot 12. That is, the protruding rib 324 is formed by protruding from the third wall 321 toward the fixing portion 21 of the corresponding signal terminal 2*a*. The protruding rib 324 and the fixing portion 21 of the corresponding signal terminal 2*a* are in interference fit, such that the insulating plug member 3 is fixed by the interference fit of the protruding ribs 324 and the fixing portions 21 of the signal terminals 2*a* in two rows, and does not easily detach backward from the insulating body 1.

As shown in FIG. 4, FIG. 6 and FIG. 7, in the left-right direction Y, a side of each first portion 32 away from the insertion slot 12 abuts the fixing portion 21 of the corresponding signal terminal 2*a*, and the second gap G2 exists between a side of each first portion 32 adjacent to the insertion slot 12 and the partition 15. Thus, the first portion 32 is located between the fixing portion 21 of the corresponding signal terminal 2*a* and the partition 15.

As shown in FIG. 2, FIG. 10 and FIG. 12, the base portion 31 is provided with a second portion 33 corresponding to each ground accommodating slot 131*b*. The first portion 32 is provided closer to the mating surface 11 than the second portion 33. In this embodiment, the second portion 33 is provided to be farther away from the mating surface 11 than the slot bottom surface 121, and the second portion 33 is completely located at an outer side of one end of the corresponding ground accommodating slot 131*b* away from the mating surface 11. In this embodiment, the second portion 33 partially shields the corresponding ground accommodating slot 131*b*. In other embodiments, the second portion 33 may protrude into the corresponding ground accommodating slot 131*b*.

As shown in FIG. 4 and FIG. 10, in each row of the terminals 2, a third distance G3 exists between the second portion 33 and the fixing portion 21 of the corresponding ground terminal 2*b*, and the distance between each first portion 32 and the fixing portion 21 of the corresponding signal terminal 2*a* is less than the third distance G3 between the second portion 33 and the fixing portion 21 of the corresponding ground terminal 2*b*. In the present embodiment, each first portion 32 abuts the fixing portion 21 of the corresponding signal terminal 2*a*, and the distance therebetween is zero.

As shown in FIG. 1, FIG. 8 and FIG. 10, the two metal members 4 are separated structures. Each metal member 4 is a sheet structure formed by punching a metal plate. The two metal members 4 are provided on the two side walls 13, and each metal member 4 is provided on a side of the corresponding side wall 13 away from the insertion slot 12. Each metal member 4 has a flat plate portion 41, and each metal member 4 is provided with a plurality of abutting arms 42 extending from the flat plate portion 41 toward the direction away from the mating surface 11. Each abutting arm 42 is cantilever shaped. Two abutting arms 42 aligning in the front-rear direction Z pass inward through the same notch 133 and abut the fixing portion 21 of the same ground terminal 2*b*, thus facilitating high frequency transmission. The flat plate portion 41 shields the notches 133 corresponding to the fixing portions 21 of the signal terminals 2*a*, thus reducing the electromagnetic interference to the signal terminals 2*a* from the outer environment. In other embodiments, the two metal members 4 may support an integral structure.

As shown in FIG. 1, FIG. 3 and FIG. 10, each metal member 4 further has a strengthening portion 43 located in front of the abutting arms 42. That is, the strengthening portion 43 is provided closer to the mating surface 11 relative to the abutting arms 42. The strengthening portion 43 is a protrusion of the metal member 4 formed on the flat plate portion 41 toward the direction away from the insertion slot 12 and extends in the front-rear direction Z and the longitudinal direction X. A length of the strengthening portion 43 extending in the longitudinal direction X is greater than a length of the strengthening portion 43 extending in the front-rear direction Z. Thus, the strengthening portion 43 is provided on the flat plate portion 41 of the metal member 4 in a long strip shape.

In sum, the electrical connector according to certain embodiments of the present invention has the following beneficial effects:

(1) By additionally providing the insulating plug member 3, the insulating plug member 3 is provided with a first portion 32 corresponding to the signal accommodating slot 131*a* and a second portion 33 corresponding to the ground accommodating slot 131*b*. The first portion 32 is provided closer to the mating surface 11 of the insulating body 1 than the second portion 33. That is, the change to the dielectric coefficient of the surrounding environment of the signal terminal 2*a* by the insulating plug member 3 is greater than the change to the dielectric coefficient of the surrounding environment of the ground terminal 2*b*. Such configuration may be used to adjust the impedance of the signal terminal 2*a*, and to satisfy the matching impedance of the signal terminal 2*a* required for transmission of high frequency signals.

(2) The first gap G1 exists between each first portion 32 and the two slot walls 1311 of the corresponding signal accommodating slot 131*a*, and the second gap G2 exists between each first portion 32 and the partition 15 in the left-right direction Y, allowing each first portion 32 to be smoothly inserted into the corresponding signal accommodating slot 131*a*.

(3) The elastic arm 22 of each signal terminal 2*a* is accommodated in the corresponding second channel H2. Gaps exists between the first oblique surface 322 and the elastic arm 22 and between the second oblique surface 1313 and the elastic arm 22 respectively, thus providing reserved spaces for the elastic arm 22 to elastically deform when being applied with a force.

(4) Each first portion 32 has the first surface 323 facing the insertion slot 12. The first surface 323 is provided to be recessed relative to the corresponding slot wall of the insertion slot 12, thus preventing each first portion 32 from protruding into the insertion slot 12 and affecting the insertion of the mating member 300 and the electrical connection between the mating member 300 and the contact portion 221.

(5) Each first portion 32 is in interference fit with the fixing portion 21 of the corresponding signal terminal 2*a* by the protruding rib 324, such that the insulating plug member 3 does not easily detach backward from the insulating body 1.

(6) The two metal members 4 are provided on the two side walls 13 and are separated structures. Each metal member 4 is provided with a plurality of abutting arms 42. Two abutting arms 42 aligning in the front-rear direction Z pass inward through the same notch 133 and abut the fixing portion 21 of the same ground terminal 2*b*, thus increasing backflow paths and enhancing the grounding effect. Each metal member 4 shields the notches 133 corresponding to the fixing portions 21 of the signal terminals 2*a*, thus reducing the electromagnetic interference to the signal terminals 2*a* from the outer environment.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be inserted with a mating member, the electrical connector comprising:

an insulating body, having a mating surface, wherein an insertion slot is concavely provided on the mating surface, a slot bottom surface is formed on a concave direction of the insertion slot, the insertion slot is configured to accommodate the mating member, the insulating body has two side walls located at two sides of the insertion slot, one of the two side walls is provided with at least one ground accommodating slot and at least one signal accommodating slot, and the signal accommodating slot and the ground accommodating slot are respectively in communication to the insertion slot;

a plurality of terminals, provided on at least one of the two side walls, wherein each of the terminals has a contact portion protruding into the insertion slot and configured to be electrically connected to the mating member, the terminals comprise at least one signal terminal and at least one ground terminal, the signal terminal is correspondingly accommodated in the signal accommodating slot, and the ground terminal is correspondingly accommodated in the ground accommodating slot; and an insulating plug member, mounted to the insulating body, wherein a side of the insulating plug member facing the mating surface is provided with a first portion corresponding to each of the at least one signal accommodating slot, and a second portion corresponding to each of the at least one ground accommodating slot, the first portion is provided closer to the mating surface than the second portion, and the first portion is accommodated in the corresponding signal accommodating slot and is provided closer to the mating surface than the slot bottom surface;

wherein the insulating body has a protruding portion protruding correspondingly toward each of the at least one signal accommodating slot, the protruding portion is formed by protruding toward the insertion slot, the protruding portion is provided closer to the mating surface than the corresponding first portion, each of the at least one signal terminal has a fixing portion retained to the corresponding signal accommodating slot, an elastic arm is formed by extending obliquely from the fixing portion toward the mating surface and the insertion slot, the contact portion is located on the elastic arm, and the protruding portion and the corresponding first portion are located at two opposite sides of the corresponding elastic arm.

2. The electrical connector according to claim 1, wherein the first portion abuts the corresponding fixing portion in a direction away from the insertion slot.

3. The electrical connector according to claim 2, wherein the first portion is provided with a protruding rib formed by protruding toward the corresponding fixing portion, and the protruding rib and the corresponding fixing portion are in interference fit.

4. The electrical connector according to claim 2, wherein each of the two side walls is provided with at least one signal accommodating slot and at least one ground accommodating slot arranged in a row, the terminals are provided in two rows on the two side walls respectively, each row of the terminals comprises at least one signal terminal and at least one ground terminal, the insulating plug member is provided with a plurality of first portions, and the first portions of the insulating plug member abut the fixing portions of the signal terminals in two rows to fix the insulating plug member.

5. The electrical connector according to claim 1, wherein the first portion has a first oblique surface, and the first oblique surface extends obliquely toward the mating surface and the insertion slot and is provided facing the corresponding elastic arm.

6. The electrical connector according to claim 5, wherein the insulating body is provided with a second oblique surface corresponding to each of the at least one signal accommodating slot, the second oblique surface extends obliquely toward the mating surface and the insertion slot, the elastic arm is located between the corresponding first oblique surface and the corresponding second oblique surface, gaps exist respectively between the elastic arm and the corresponding first oblique surface and between the elastic arm and the corresponding second oblique surface, the insulating body has a protruding portion protruding correspondingly toward each of the at least one signal accommodating slot, the protruding portion is formed by protruding toward the insertion slot, the protruding portion is provided closer to the mating surface than the corresponding first portion, and the protruding portion has the second oblique surface.

7. The electrical connector according to claim 1, wherein the first portion has a first surface facing the insertion slot, and the first surface is provided to be recessed relative to a slot wall of the insertion slot.

8. The electrical connector according to claim 1, wherein the one of the two side walls is provided with two adjacent signal accommodating slots and two ground accommodating slots, the two adjacent signal accommodating slots are located between the two ground accommodating slots, two signal terminals accommodated in the two adjacent signal accommodating slots are configured to transmit differential signals.

9. The electrical connector according to claim 1, wherein the second portion is completely located at an outer side of one end of the corresponding ground accommodating slot away from the mating surface.

10. The electrical connector according to claim 1, wherein each of the at least one signal accommodating slot runs through the mating surface, the insulating body is provided with a pre-pressurized block in each of the at least one signal accommodating slot, the pre-pressurized block is provided closer to the mating surface relative to the corresponding protruding portion and adjacent to the insertion slot, the protruding portion extends toward the insertion slot and does not pass beyond a side edge of the corresponding pre-pressurized block away from the insertion slot, each of the at least one signal terminal is provided with a pre-pressurized arm formed by extending from the contact portion toward the mating surface, and the pre-pressurized arm abuts the corresponding pre-pressurized block prior to the mating member being inserted into the insertion slot.

11. The electrical connector according to claim 1, wherein the insulating body has a foolproof portion located in the insertion slot, the foolproof portion is formed by extending from the slot bottom surface toward the mating surface, the foolproof portion divides the insertion slot into a long slot and a short slot having different lengths in a longitudinal direction, and the insulating plug member is mounted on a side of the insulating body corresponding to the long slot and away from the mating surface.

12. An electrical connector, configured to be inserted with a mating member, the electrical connector comprising:

an insulating body, having a mating surface, wherein an insertion slot is concavely provided on the mating surface, a slot bottom surface is formed on a concave direction of the insertion slot, the insertion slot is configured to accommodate the mating member, the insulating body has two side walls located at two sides of the insertion slot, one of the two side walls is provided with at least one ground accommodating slot and at least one signal accommodating slot, and the signal accommodating slot and the ground accommodating slot are respectively in communication to the insertion slot;

a plurality of terminals, provided on at least one of the two side walls, wherein each of the terminals has a contact portion protruding into the insertion slot and configured to be electrically connected to the mating member, the terminals comprise at least one signal terminal and at least one ground terminal, the signal terminal is correspondingly accommodated in the signal accommodating slot, and the ground terminal is correspondingly accommodated in the ground accommodating slot; and an insulating plug member, mounted to the insulating body, wherein a side of the insulating plug member facing the mating surface is provided with a first portion corresponding to each of the at least one signal accommodating slot, and a second portion corresponding to each of the at least one ground accommodating slot, the first portion is provided closer to the mating surface than the second portion, and the first portion is accommodated in the corresponding signal accommodating slot and is provided closer to the mating surface than the slot bottom surface;

wherein each of the terminals has a fixing portion and an elastic arm formed by extending from the fixing portion, the contact portion is provided on the elastic arm, the fixing portion of each of the at least one ground terminal retains to the corresponding ground accommodating slot, the fixing portion of each of the at least one signal terminal retains to the corresponding signal accommodating slot, the one of the two side walls is provided with a plurality of notches corresponding to the fixing portions of the terminals, each of the notches is connected to a corresponding one of the fixing portions of the terminals and runs outward through the corresponding side wall in a direction away from the insertion slot, a side of the one of the two side walls away from the insertion slot is covered by a metal member, the metal member is provided with at least one abutting arm extending toward a direction away from the mating surface, and the abutting arm passes through the notch corresponding to the fixing portion of the ground terminal and abuts the fixing portion of the ground terminal.

13. The electrical connector according to claim 12, wherein the metal member has a strengthening portion, the strengthening portion is a protrusion formed on the metal member toward the direction away from the insertion slot, and the strengthening portion is provided closer to the mating surface relative to the abutting arm.

14. The electrical connector according to claim 12, wherein the metal member shields the notches corresponding to the fixing portions of the signal terminals on the corresponding side wall.

15. An electrical connector, configured to be inserted with a mating member, the electrical connector comprising:

an insulating body, having a mating surface, wherein an insertion slot is concavely provided on the mating surface, a slot bottom surface is formed on a concave direction of the insertion slot, the insertion slot is configured to accommodate the mating member, the insulating body has two side walls located at two sides of the insertion slot, one of the two side walls is provided with at least one ground accommodating slot and at least one signal accommodating slot, and the signal accommodating slot and the ground accommodating slot are respectively in communication to the insertion slot;

a plurality of terminals, provided on at least one of the two side walls, wherein each of the terminals has a contact portion protruding into the insertion slot and configured to be electrically connected to the mating member, the terminals comprise at least one signal terminal and at least one ground terminal, the signal terminal is correspondingly accommodated in the signal accommodating slot, and the ground terminal is correspondingly accommodated in the ground accommodating slot; and an insulating plug member, mounted to the insulating body, wherein a side of the insulating plug member facing the mating surface is provided with a first portion corresponding to each of the at least one signal accommodating slot, and a second portion corresponding to each of the at least one ground accommodating slot, the first portion is provided closer to the mating surface than the second portion, and the first portion is accommodated in the corresponding signal accommodating slot and is provided closer to the mating surface than the slot bottom surface.

16. The electrical connector according to claim 15, wherein each of the at least one signal terminal has a fixing portion retained to the corresponding signal accommodating slot, the first portion abuts the corresponding fixing portion in a direction away from the insertion slot, an elastic arm is formed by extending from the fixing portion toward the mating surface, and the contact portion is located on the elastic arm.

17. The electrical connector according to claim 16, wherein each of the two side walls is provided with at least one signal accommodating slot and at least one ground accommodating slot arranged in a row, the insulating body has a partition extending from the slot bottom surface toward a direction away from the mating surface, the partition separates the two rows of the signal accommodating slot and the ground accommodating slot on the two side walls from each other, the terminals comprise a plurality of signal terminals and a plurality of ground terminals, each of the two side walls is correspondingly provided with at least one of the signal terminals and at least one of the ground terminals, and the first portion is located between the fixing portion of a corresponding one of the signal terminals and the partition.

18. The electrical connector according to claim 16, wherein each of the two side walls is provided with at least one signal accommodating slot and at least one ground accommodating slot arranged in a row, the terminals are provided in two rows on the two side walls respectively, each row of the terminals comprises at least one signal terminal and at least one ground terminal, the insulating plug member is provided with a plurality of first portions, and the first portions of the insulating plug member abut the fixing portions of the signal terminals in two rows to fix the insulating plug member.

19. The electrical connector according to claim 15, wherein each of the at least one signal terminal has a fixing portion retained to the corresponding signal accommodating slot, an elastic arm is formed by extending obliquely from the fixing portion toward the mating surface and the insertion slot, the contact portion is located on the elastic arm, the first portion has a first oblique surface, and the first oblique surface extends obliquely toward the mating surface and the insertion slot and is provided facing the corresponding elastic arm.

20. The electrical connector according to claim 19, wherein the insulating body is provided with a second oblique surface corresponding to each of the at least one signal accommodating slot, the second oblique surface extends obliquely toward the mating surface and the insertion slot, the elastic arm is located between the corresponding first oblique surface and the corresponding second oblique surface, and gaps exist respectively between the elastic arm and the corresponding first oblique surface and between the elastic arm and the corresponding second oblique surface.

21. The electrical connector according to claim 15, wherein the first portion has a first surface facing the insertion slot, and the first surface is provided to be recessed relative to a slot wall of the insertion slot.

22. The electrical connector according to claim 15, wherein each of the two side walls is provided with at least one signal accommodating slot and at least one ground accommodating slot arranged in a row, the insulating body has a partition extending from the slot bottom surface toward a direction away from the mating surface, the partition separates the two rows of the signal accommodating slot and the ground accommodating slot on the two side walls from each other, the terminals comprise a plurality of signal terminals and a plurality of ground terminals, each of the two side walls is correspondingly provided with at least one of the signal terminals and at least one of the ground terminals, each of the at least one signal accommodating slot has two slot walls provided opposite to each other in a longitudinal direction, a first gap exists between the first portion and the two slot walls of a corresponding one of the at least one signal accommodating slot in the longitudinal direction, and a second gap exists between the first portion and the partition.

23. The electrical connector according to claim 15, wherein a left-right direction is defined, the two side walls are located at a left side and a right side of the insertion slot, the insulating plug member has a base portion, the first portion is formed by extending from the base portion, the signal terminal has a fixing portion correspondingly retained in the signal accommodating slot, and the first portion is located closer to the fixing portion of the signal terminal than the base portion in the left-right direction.

24. The electrical connector according to claim 23, wherein the ground terminal has a fixing portion correspondingly retained in the ground accommodating slot, and in the left-right direction, a distance between the first portion and the fixing portion of the signal terminal is less than a distance between the second portion and the fixing portion of the ground terminal.

25. The electrical connector according to claim 15, wherein each of the two side walls is provided with at least one signal accommodating slot and at least one ground accommodating slot arranged in a row, the insulating body has a partition extending from the slot bottom surface toward a direction away from the mating surface, the partition separates the two rows of the signal accommodating slot and the ground accommodating slot on the two side walls from each other, the terminals comprise a plurality of signal terminals and a plurality of ground terminals, each of the two side walls is correspondingly provided with at least one of the signal terminals and at least one of the ground terminals, the insulating plug member has a base portion, the first portion is formed by extending from the base portion, and the base portion abuts the partition along a direction toward the mating surface.

* * * * *